US005107250A

United States Patent [19]

Pykett

[11] Patent Number: 5,107,250

[45] Date of Patent: Apr. 21, 1992

[54] DETECTION OF MOVING OBJECTS

[75] Inventor: Colin E. Pykett, Malvern, England

[73] Assignee: The Secretary of State for Defence in Her Britannic Majesty's Government of Great Britain and Northern Ireland, London, England

[21] Appl. No.: 116,343

[22] Filed: Jan. 7, 1980

[51] Int. Cl.[5] ..... G08B 13/00; G08B 13/22

[52] U.S. Cl. ..... 340/566; 367/136

[58] Field of Search ..... 367/136; 340/566

[56] References Cited

U.S. PATENT DOCUMENTS

| | | | |
|---|---|---|---|
| 3,665,445 | 5/1972 | Riley | 340/566 |
| 3,717,864 | 2/1973 | Cook et al. | 367/136 |
| 3,745,552 | 7/1973 | Wilt | 340/566 |
| 3,805,260 | 4/1974 | Barowitz | 367/136 |
| 3,824,532 | 7/1974 | Vandierendonck | 340/566 |
| 3,913,085 | 10/1975 | Farstad | 340/566 |
| 4,081,785 | 3/1978 | Ravis et al. | 340/566 |
| 4,099,168 | 7/1978 | Kedjierski et al. | 340/566 |
| 4,158,832 | 6/1979 | Barnes et al. | 340/566 |
| 4,196,423 | 4/1980 | Carver et al. | 340/566 |
| 4,223,304 | 9/1980 | Barowitz et al. | 340/566 |

FOREIGN PATENT DOCUMENTS

| | | | |
|---|---|---|---|
| 0936270 | 9/1963 | United Kingdom | 340/566 |
| 1139600 | 1/1969 | United Kingdom | 340/566 |
| 1246264 | 9/1971 | United Kingdom | 340/566 |

OTHER PUBLICATIONS

Pykett, "The Detection and Identification of Vehicles Using Seismic Techniques", Aug. 1975, pp. 317-319, Traffic Eng. and Control (GB), vol. 16, #7.

Pykett, "Machine Recognition in a Multiple Object Environment", Jun. 24, 1976, pp. 138, IEEE Union Radio Sci. Internat. Symposium Information Theory, Ronneby, Sweden.

*Primary Examiner*—Nelson Moskowitz

*Attorney, Agent, or Firm*—Pollock, VandeSande and Priddy

[57] ABSTRACT

A system for detecting and classifying vehicles, moving in the vicinity of a seismic detector, includes a time threshold circuit and, complementary to this circuit, two parallel amplitude detector circuits. One detector circuit utilizes amplitude thresholding to distinguish the seismic vibrations characteristic of moving vehicles, from other seismic vibrations. The other detector circuit utilizes amplitude thresholding to distinguish the seismic vibrations characteristic of a particular kind of moving vehicle (e.g. a tracked vehicle), from other seismic vibrations. The results of these two amplitude detector circuits and of the time threshold circuit are utilized by an indicator circuit and an indication of detected vehicle kind (e.g. tracked or wheeled) provided. Indication may be relayed, to a remote observer, by radio transmission.

5 Claims, 3 Drawing Sheets

DETECTION OF MOVING OBJECTS

Figure 1:
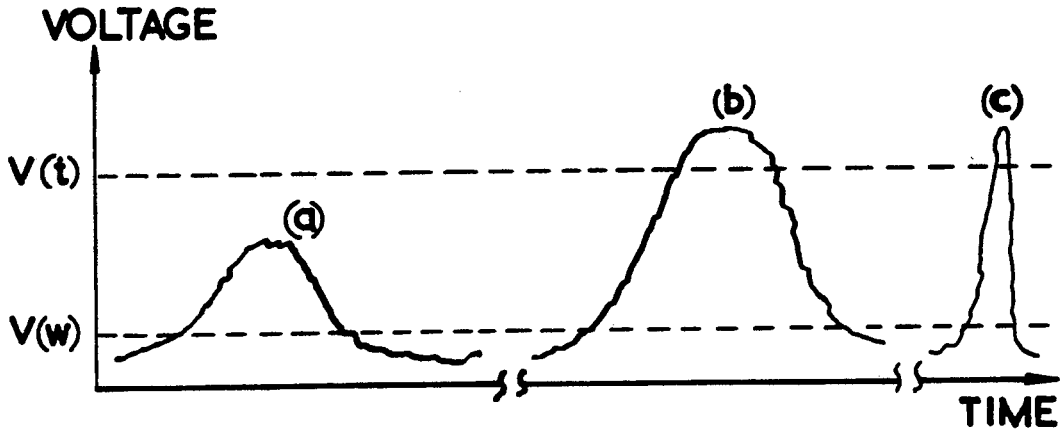

The present invention relates generally to the detection of moving objects and particularly to the recognition of and the differentiation between different kinds of vehicles.

There are several ways in which moving objects can be detected and recognized in the case of an object moving across the ground one way of detecting the object is to obtain information from the seismic vibrations which it produces. Seismic vibrations propagate in the ground in several modes of elastic wave motion. Some of these are confined to the neighbourhood of the surface of the ground and are thus known as surface waves. Information about the moving object can extracted from a seismic detector placed on the ground so as to detect surface waves.

According to the present invention a system for the detection of vehicles includes a seismic detector providing an electrical output and circuitry responsive to the output including a first detector capable of determining whether the peak amplitude of the output signal from the seismic detector is above or below a first amplitude threshold which distinguishes between signals due to vehicles and signals not due to vehicles, a second detector arranged in parallel with the first detector and capable of determining whether the peak amplitude of the said signal is above or below a second amplitude threshold higher than the first amplitude threshold which distinguishes between signals due to particular kinds of vehicles, a third detector arranged in parallel with the first and second detectors and capable of determining whether the duration of the said signal is above or below a time threshold which distinguishes between signals due to vehicles, and signals not due to vehicles and indicator means for indicating to a local or remote observer the states of the three detectors contemporaneously.

The first amplitude threshold and the time threshold are used to differentiate between moving objects which are vehicles and moving objects which are not vehicles, and the second amplitude threshold and the time threshold can, for example, be one used to differentiate between tracked vehicles and wheeled vehicles.

The first and third detectors can for example each be a combination of at least one amplifier, a signal peak extractor and a comparator for determining whether the peak of the output of the amplifier is above or below the level of a reference signal representative of the appropriate threshold.

The third detector preferably incorporates a C-R network arranged so that the capacitor is charged by the signal after amplification, and a device for determining whether the capacitor is still charging after a given time interval.

The indicator means can, for example, include an optical display element such as a lamp for indication to a local observer or a radio transmitter for transmitting indicator signals for remote observation.

Figure 3:
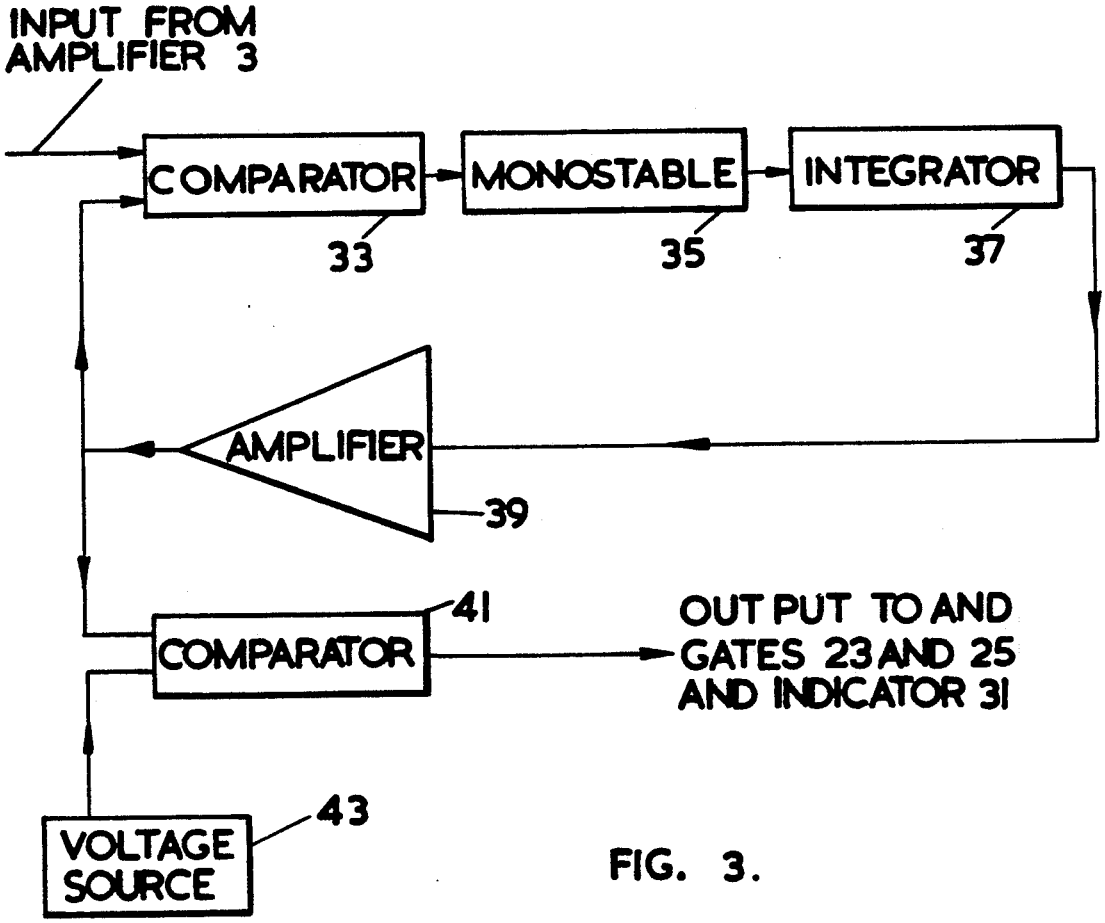
Figure 2:
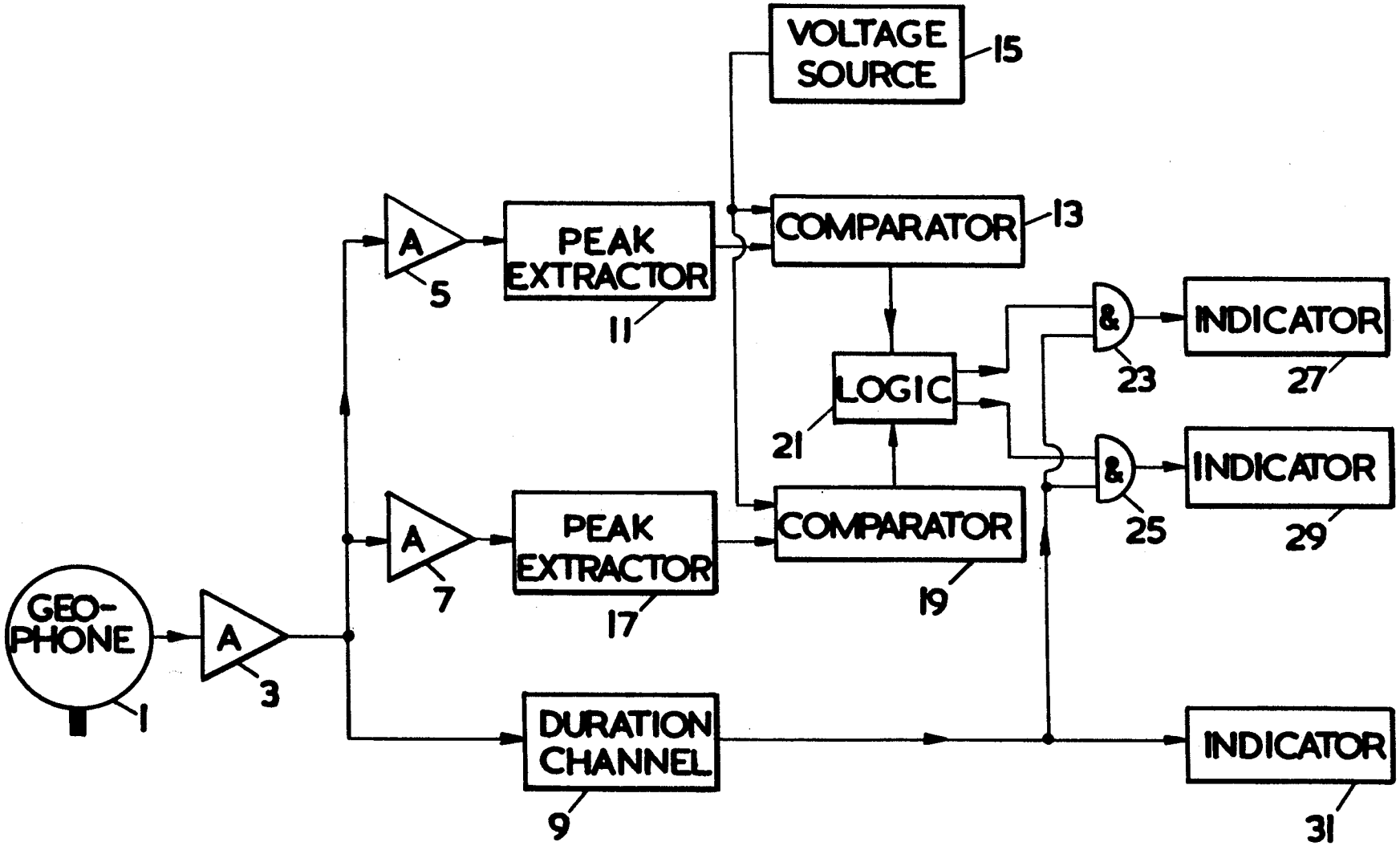

Embodiments of the present invention will be described by way of example with reference to the accompanying drawings, in which:

FIG. 1: is a graph of voltage against time illustrating possible envelope outputs from a seismic detector arranged to detect seismic vibrations;

FIG. 2: is a block schematic diagram of a vehicle classifier embodying the present invention;

FIG. 3: is a block schematic diagram illustrating part of the classifier of FIG. 2 in more detail;

FIGS. 4(*a*) to 4(*d*): are waveforms illustrating the operation of the part of the classifier illustrated in FIG. 3.

It is an object of the present invention in one aspect to differentiate with a reasonable degree of success between moving objects which are vehicles and those which are not and to classify those vehicles detected into tracked vehicles, e.g. military tanks, and wheeled vehicles, e.g. cars and trucks. FIG. 1 is a graph of voltage against time illustrating possible voltage envelope profiles from a seismic detector arranged to detect seismic vibrations. It illustrates three unrelated typical waveforms (a), (b) and (c) which would be obtained as the output profiles, i.e. envelopes, in the case of respectively a wheeled vehicle, a tracked vehicle and an explosion from a gun. The waveform (a) consists orginally of noise before the vehicle is within range of detection. As the vehicle comes into range the peak amplitude of the seismic vibrations it produces gradually rises above the noise level until the vehicle passes the nearest point to the geophone and thereafter falls again as the vehicle goes out of range of detection again. A first threshold V(w) can be used to differentiate the signal from noise. The waveform (b) is similar to the waveform (a) except that the waveform (b) reaches a higher peak when the vehicle is at the nearest point to the geophone. A second threshold V(t) can be used to distinguish the waveform (b) from the waveform (a).

In connection with the present invention it has been discovered that in general tracked vehicles always produce a peak amplitude seismic signal higher than that produced by a wheeled vehicle (even when the tracked vehicle is travelling slowly on soft ground and the wheeled vehicle is travelling quickly on hard ground). Therefore the waveform (b) can be recognized as that produced by a tracked vehicle because it rises above the threshold V(t). The waveform (c) also rises above both thresholds V(w), V(t) because it is produced by an explosion. However the waveforms (a) and (b) can be distinguished from the waveform (c) because they exist for a much longer time.

FIG. 2 is a block schematic diagram of a vehicle classifier embodying the present invention. A geophone 1 is placed close to a route (not shown) to be monitored. The geophone 1 receives seismic vibrations and produces an output signal representative of their magnitude. The output signal is amplified by an amplifier 3. The output of the amplifier 3 is fed to each of an amplifier 5, an amplifier 7 and a duration channel 9 arranged in parallel. The respective gains, of the amplifier 5, A5, and the amplifier 7, A7, are such that:

$$\frac{A7}{A5} = \frac{V(t)}{V(w)}$$

where V(t) and V(w) are the thresholds illustrated in FIG. 1. The peak amplitudes of the signal produced by the amplifier 5 are extracted by a signal peak extractor 11. The output of the peak extractor 11 is compared in a comparator 13 with a fixed voltage produced by a voltage source 15. Likewise the peak amplitudes of the signal produced by the amplifier 7 are extracted by a signal peak extractor 17 whose output is a compared in a comparator 19 with the fixed reference voltage produced by the voltage source 15.

The comparator 13 produces a "1" output whenever the output of the peak extractor 11 is greater than the reference voltage and a "0" output whenever the output of the peak extractor 11 is less than the reference voltage. Likewise, the comparator 19 produces a "1" output whenever the output of the peak extractor 17 is greater than the reference voltage and a "0" output whenever the output of the peak extractor 17 is less than the reference voltage. The output of the comparator 13 and the output of the comparator 19 are fed to logic 21. The logic 21 has two outputs, one to an AND gate 23 and one to an AND gate 25. The logic 21 computes from the outputs from the comparator 13 and the comparator 19 whether a vehicle is detected and, if so, whether it is a tracked vehicle or a wheeled vehicle. If a tracked vehicle is detected the logic 21 feeds an output signal to the AND gate 23. If a wheeled vehicle is detected the logic 21 feeds an output signal to the AND gate 25.

The duration of the seismic signal produced by any moving object is detected in the duration channel 9. This produces an output signal representing detection of a vehicle only if the duration of the seismic signal is greater than a predetermined time threshold. If the duration channel 9 produces an output, the output is fed in parallel to the AND gate 23 and the AND gate 25. Whenever the AND gate 23 detects contemporaneously an output from the logic 21 and an output from the duration channel 9 it causes an indicator 27 to operate indicating detection of a tracked vehicle. Whenever the AND gate 25 detects an output from the logic 21 contemporaneously with an output from the duration channel 9 it causes an indicator 29 to operate indicating detection of a wheeled vehicle.

The output of the duration channel 9 may also be fed directly to an indicator 31 to indicate any detected seismic signal having a duration greater than the predetermined time threshold. The indicator 31 can be used to alert an observer that vehicles may be approaching the vehicle classifier.

Since the amplifiers 5, 7 have gains in the ratio of the thresholds V(w), V(t) the signals compared with the reference voltage in the comparators 13, 19 are in that ratio. Therefore the comparator 19 detects whether the seismic signal is greater than V(w), and the comparator 13 detects whether the seismic signal is greater than V(t). If a tracked vehicle is detected there is a "1" output from both the comparator 13 and the comparator 19. If a wheeled vehicle is detected a "0" output is produced by the comparator 13 and a "1" output is produced by the comparator 19. If no vehicle is detected a "0" output is produced by both of the comparators 13, 19. In the course of comparing the outputs from the comparator 13 and the comparator 19 the logic 21 delays producing an output if a "1" output is indicated by the comparator 19 only until the maximum value of the seismic signal (the maximum output from the peak extractor 17) has been detected. This ensures that the indicator 29 is not operated erroneously in the case of a tracked vehicle which has only begun to come into range of detection.

The indicators 27, 29 and 31 can for example be optical indicators such as lamps which can be supplemented with audio indicators such as buzzers. Alternatively they can include radio transmitters which are used to transmit radio signals to a remote receiver if the vehicle classifier is left unattended.

In another embodiment of the invention the amplifiers 5, 7 can have the same gain; in that case a further voltage source will be used providing a further reference voltage V(t)/V(w) times greater than that produced by the voltage source 15. The reference voltage produced by the voltage source 15 will be applied only to the comparator 19, while that produced by the further reference source will be applied only to the comparator 13.

FIG. 3 is a block schematic diagram of the duration channel 9 shown in FIG. 2. The input from the amplifier 3 is compared in a comparator 33 with a signal generated by a feed-back loop consisting in turn of the comparator 33, a monostable circuit 35, an integrator 37 and an amplifier 39. The output from the amplifier 39 to the comparator 33 is also compared in a comparator 41 with a fixed reference voltage produced by a voltage source 43. The comparator 41 has a "1" output whenever its input from the amplifier 39 is greater than the reference voltage. Otherwise it has a "0" output. The output of the comparator 41 is fed directly to the AND gate 23, the AND gate 25 and the indicator 31.

Figure 4A:
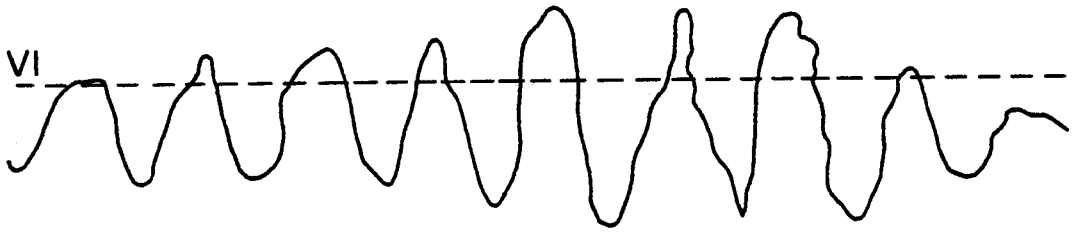
Figure 4B:
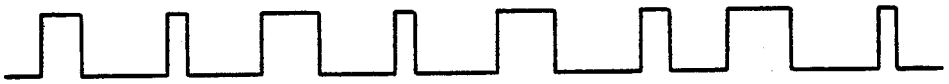
Figure 4C:
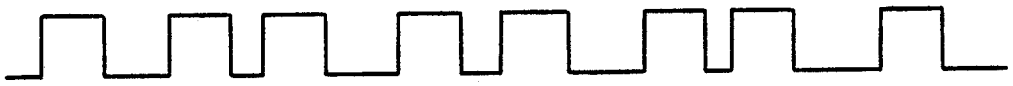
Figure 4D:
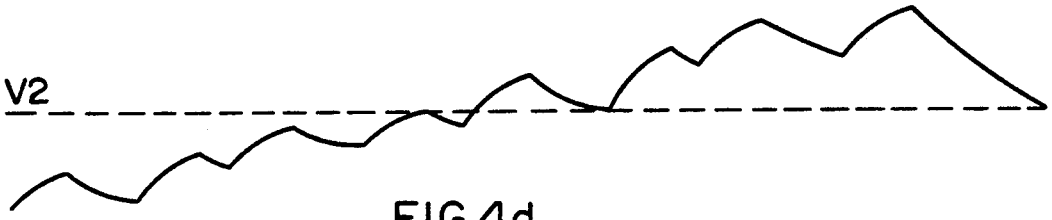

Operation of the duration channel 9 will now be described with reference to FIGS. 4*a* to 4*d* which are typical waveforms of signal amplitude as a function of time. The input from the amplifier 3 is illustrated in FIG. 4*a*. An actual waveform might contain many cycles more than those shown in FIG. 4*a*. The comparator 33 produces an output pulse whenever the input from the amplifier 3 is greater than a voltage V1 determined by the characteristics of the feed-back loop. These pulses are shown in FIG. 4*b*. The monostable circuit 35 produces a series of pulses each of equal length for each input pulse received from the comparator 33. This series is shown in FIG. 4*c*. The integrator 37 consists basically of a C-R network. Each pulse in the series from the monostable circuit 35 will charge the capacitor of the integrator 37. If the pulses from the monostable circuit 35 are spaced closely enough together the capacitor of the integrator 37 will not fully discharge between pulses and the voltage across it will therefore rise as shown in FIG. 4*d*. The fixed reference voltage produced by the voltage source 43 is denoted in FIG. 4*d* by the level V2. When the voltage across the capacitor of the integrator 37 is sufficiently high, after amplification by the amplifier 39, to be greater than the reference voltage V2 the comparator 41 produces an output.

The time constant of the C-R network of the integrator 37 is selected so that the duration channel 9 can be used to distinguish between signals from vehicles, which in general are of high frequency, and signals from people or animals which are in general of low frequency. In other words the time constant is selected so that the capacitor of the integrator 37 is continually charged by the signals due to a vehicle but not charged by the signals due to a person or an animal. Also, if a short signal occurs it will begin to charge the capacitor of the integrator 37 but as soon as the signal dies away the capacitor will discharge. Therefore the reference voltage V2 can be set so that any signal of short duration, for example from an explosion of a gun, will not charge the capacitor of the integrator 37 sufficiently to reach the voltage level V2 required for the comparator 41 to give an output.

The voltage V1 is in general variable although it is shown in FIG. 4*a* as being a steady level because over the first few cycles of an input signal it does not vary, as a result of the delay corresponding to the time constant of the integrator 37.

It has been found that operating over an approximate range of 0 to 5 meters and using a commercial geophone GSC 20D (manufactured by Geospace Corporation) the thresholds V(t) and V(w) (FIG. 1) are respectively 3.3 mV (rms) and 0.3 mV (rms) respectively.

I claim:

1. In a system for detecting moving ground vehicles of the type including a seismic detector capable of detecting seismic vibrations generated by moving vehicles and of providing in response a corresponding electrical signal; first detector means connected to the seismic detector, responsive to the electrical signal, for providing a first information signal, to distinguish electrical signals having peak amplitudes above and below a first amplitude threshold, namely a threshold of such set value as to distinguish electrical signals corresponding to seismic vibrations of peak amplitude characteristic of moving ground vehicles, from electrical signals corresponding to other seismic vibrations; and indicator means connected to the first detector means, responsive to the information signal therefrom, for indicating the presence of a detected moving vehicle; the improvement comprising a second detector means connected to the seismic detector, parallel to the first detector means, responsive to the electrical signal, for providing a further information signal, to distinguish electrical signals having peak amplitudes above and below a second amplitude threshold, namely a threshold of such set value as to distinguish electrical signals corresponding to seismic vibrations of peak amplitude characteristic of moving ground vehicles of a particular kind from electrical signals corresponding to seismic vibrations of peak amplitude characteristic of other sources including moving vehicles not of this particular kind; said indicator means also being responsive to said further information signal, and being capable of providing in response an indication of the kind of moving vehicle detected, said system further including a duration channel connected to the seismic detector for discriminating against electrical signals of less than and longer than a given time interval, the duration channel including, connected in series in the following order: a first signal comparator, a monostable, an integrator, and an amplifier; the amplifier being connected to the first signal comparator to provide a first reference signal, the duration channel also including a second signal comparator connected to the amplifier, and a voltage source connected to the second signal comparator to provide a second reference signal for defining the time interval.

2. A system according to claim 1 wherein the second amplitude threshold is such as to distinguish an electrical signal corresponding to seismic vibrations that are of peak amplitude characteristic of a moving tracked vehicle from an electrical signal corresponding to seismic vibrations that are of peak amplitude characteristic of other sources including moving wheeled vehicles.

3. A system according to claim 1 wherein the indicator means includes a logic circuit capable of responding to changes of said information signals, the logic circuit being capable of providing a delayed indication whenever the first information signal changes corresponding to an electrical signal of peak amplitude rising above the first amplitude threshold, the indication distinguishing between two outcomes, namely: a first outcome where the further information signal changes corresponding to an electrical signal of peak amplitude that rises above the second amplitude threshold; and a second outcome where the electrical signal peak amplitude rises to a maximum amplitude between the first and second amplitude thresholds.

4. A system according to claim 3 wherein the logic circuit is capable of comparing changes of said information signals, and detecting, and providing indication of, the second outcome by checking between changes of the first information signal corresponding to an electrical signal of peak amplitude that rises above and falls below the first amplitude threshold, that there is no change in the further information signal.

5. A system according to claim 1 wherein each detector means includes: an amplifier of specified gain a peak extractor connected to the amplifier for determining the peak amplitude of electrical signals amplified thereby, and a comparator connected to the peak extractor; and a common voltage source connected to the comparators; the amplifiers each being of different gain and in combination with the voltage source defining respectively the first and second amplitude thresholds for distinguishing the electrical signals.

* * * * *